US008607852B2

(12) United States Patent
Strömer et al.

(10) Patent No.: US 8,607,852 B2
(45) Date of Patent: Dec. 17, 2013

(54) DISTRIBUTION PIPE

(75) Inventors: Fredrik Strömer, Kävlinge (SE); Sven Andersson, Hässleholm (SE); Thomas Dahlberg, Helsingborg (SE); Svante Hoberg, Åstorp (SE); Dirk Sterner, Helsingborg (SE)

(73) Assignee: Swep International AB, Landskrona (SE)

( * ) Notice: Subject to any disclaimer, the term of this patent is extended or adjusted under 35 U.S.C. 154(b) by 0 days.

(21) Appl. No.: 12/743,090

(22) PCT Filed: Nov. 14, 2008

(86) PCT No.: PCT/EP2008/009660
§ 371 (c)(1), (2), (4) Date: Oct. 7, 2011

(87) PCT Pub. No.: WO2009/062738
PCT Pub. Date: May 22, 2009

(65) Prior Publication Data
US 2012/0061064 A1 Mar. 15, 2012

(30) Foreign Application Priority Data
Nov. 14, 2007 (SE) ..... 0702499

(51) Int. Cl.
*F28F 9/02* (2006.01)

(52) U.S. Cl.
USPC ..... 165/174

(58) Field of Classification Search
USPC ..... 165/174
See application file for complete search history.

(56) References Cited

U.S. PATENT DOCUMENTS

| | | | | |
|---|---|---|---|---|
| 2,097,602 | A | 11/1937 | Rohlin | |
| 3,976,128 | A | 8/1976 | Patel et al. | |
| 5,513,700 | A * | 5/1996 | Kleve et al. | 165/153 |
| 6,158,503 | A | 12/2000 | Gille et al. | |
| 6,729,386 | B1 | 5/2004 | Sather | |
| 8,113,270 | B2 * | 2/2012 | Rios et al. | 165/287 |
| 2004/0026072 | A1 | 2/2004 | Yi et al. | |

FOREIGN PATENT DOCUMENTS

| | | |
|---|---|---|
| JP | 2004-101132 | 4/2004 |
| WO | WO 94/14021 | 6/1994 |
| WO | WO 2006/083426 | 8/2006 |

OTHER PUBLICATIONS

Swedish Office Action for corresponding Swedish Application No. 0702499-5 mailed May 16, 2008.

* cited by examiner

*Primary Examiner* — Brandon M Rosati
(74) *Attorney, Agent, or Firm* — Merchant & Gould P.C.

(57) ABSTRACT

A distribution pipe (100) for a heat exchanger (300) including at least two parallel channels for a first medium exchanging heat with a second medium comprises a distribution portion (110) provided with a number of holes (120) provided on positions corresponding to the position of the parallel channels. A fitting portion (140) is in fluid communication with the distribution portion (110) and placed at one end of such distribution portion (110), wherein the fitting portion is provided with a brazing surface (150) adapted to be brazed onto an end plate (200) or a start plate (320).

3 Claims, 4 Drawing Sheets

DISTRIBUTION PIPE

This application is a National Stage Application of PCT/EP2008/009660, filed 14 Nov. 2008, which claims benefit of Serial No. 0702499-5, filed 14 Nov. 2007 in Sweden and which applications are incorporated herein by reference. To the extent appropriate, a claim of priority is made to each of the above disclosed applications.

FIELD OF THE INVENTION

The present invention related to a distribution pipe for a heat exchanger comprising at least two parallel channels for a first medium exchanging heat with a second medium, wherein the distribution pipe comprises a distribution portion (110) provided with a number of holes provided on positions corresponding to the position of the parallel channels. The invention also relates to a heat exchanger provided with the distribution pipe.

PRIOR ART

In the art of heat exchangers comprising a number of parallelly arranged flow paths for fluids, it is of importance to be able to control the distribution of fluid passing the parallel paths. In e.g. plate heat exchangers adapted for exchanging heat between a refrigerant and brine, there are often a large number of parallel channels through which the refrigerant may pass; mostly, the refrigerant will enter the heat exchanger in a direction perpendicular to the channels, meaning that the refrigerant must make a 90 degree turn prior to entering the channels. Because of this, maldistribution of the refrigerant flow might occur (often, the flow of refrigerant is highest in the channel that is most distant from the position where the refrigerant enters the heat exchanger). Other factors that affect the maldistribution are type of refrigerant, how many parallel channels that are used in the heat exchanger and whether the inlet and the outlet are located on the same plate or on opposing plates.

Many possible solutions for overcoming this problem have been presented during the years, and they function well. One such solution is to provide the entrance of each channel with a small opening, which will prevent a too large flow of refrigerant into a specific channel. The small openings can be arranged by washers provided with a small hole and placed in the opening to the channel. Another option is to arrange an elongate pipe extending in the direction of the entrance and exhibiting a number of small holes, wherein each of the small holes is directed into a channel. Usually, such a pipe is referred to as a distribution pipe.

Moreover, a heat exchanger must be provided with fittings for allowing piping to be fastened to the heat exchanger. It is more or less an industry standard to provide different kinds of fittings for the refrigerant circuit and the brine circuit; for the refrigerant circuit, the most common type of fitting is a solder fitting (into which a pipe can be soldered or brazed) and for the brine circuit, it is most common to use a threaded fitting.

In the prior art systems including a distribution pipe, see e.g. EP 0 706 633, the most common solution is to arrange a distribution pipe having an outside diameter slightly smaller than the inside diameter of the refrigerant inlet fitting. In order to avoid leakage of refrigerant, seals sealing the contact between the distribution pipe and the fitting might be provided. The seals might e.g. be o-rings fitted in external grooves of the distribution pipe.

In order to achieve an as high efficiency as possible, it is important that the small holes of the distribution pipe are directed in correct manner, not only in terms of height, i.e. such that the flow of coolant out from the holes is aligned with a corresponding opening into a channel, it is also important in which direction the flow out from the holes is directed. In the prior art systems, there are no solutions to the direction problem connected to installation of distribution pipes. This problem will be more thoroughly described in the section "DESCRIPTION OF EMBODIMENTS".

The invention aims to solve these and other problems connected with the prior art solutions.

SUMMARY OF THE INVENTION

According to the invention, these and other problems are solved by providing a distribution pipe with a fitting portion in fluid communication with the distribution portion, wherein the fitting portion is provided with a brazing surface adapted to be brazed onto an end plate.

In order to facilitate manufacturing, the fitting portion could comprise a guiding surface, whose diameter is such that it snugly fits into an opening of the end plate.

In order to avoid misaligning of the distribution pipe, the guiding surface could be provided with a recess, wherein the opening of the end plate has a shape that corresponds to the recessed guiding surface, such that the distribution pipe only can be mounted in the opening in one direction.

According to the invention, the distribution pipe could be used in a heat exchanger.

BRIEF DESCRIPTION OF THE DRAWINGS

Hereinafter, the invention will be described with reference to the appended drawings, wherein.

DESCRIPTION OF EMBODIMENTS

Figure 1:
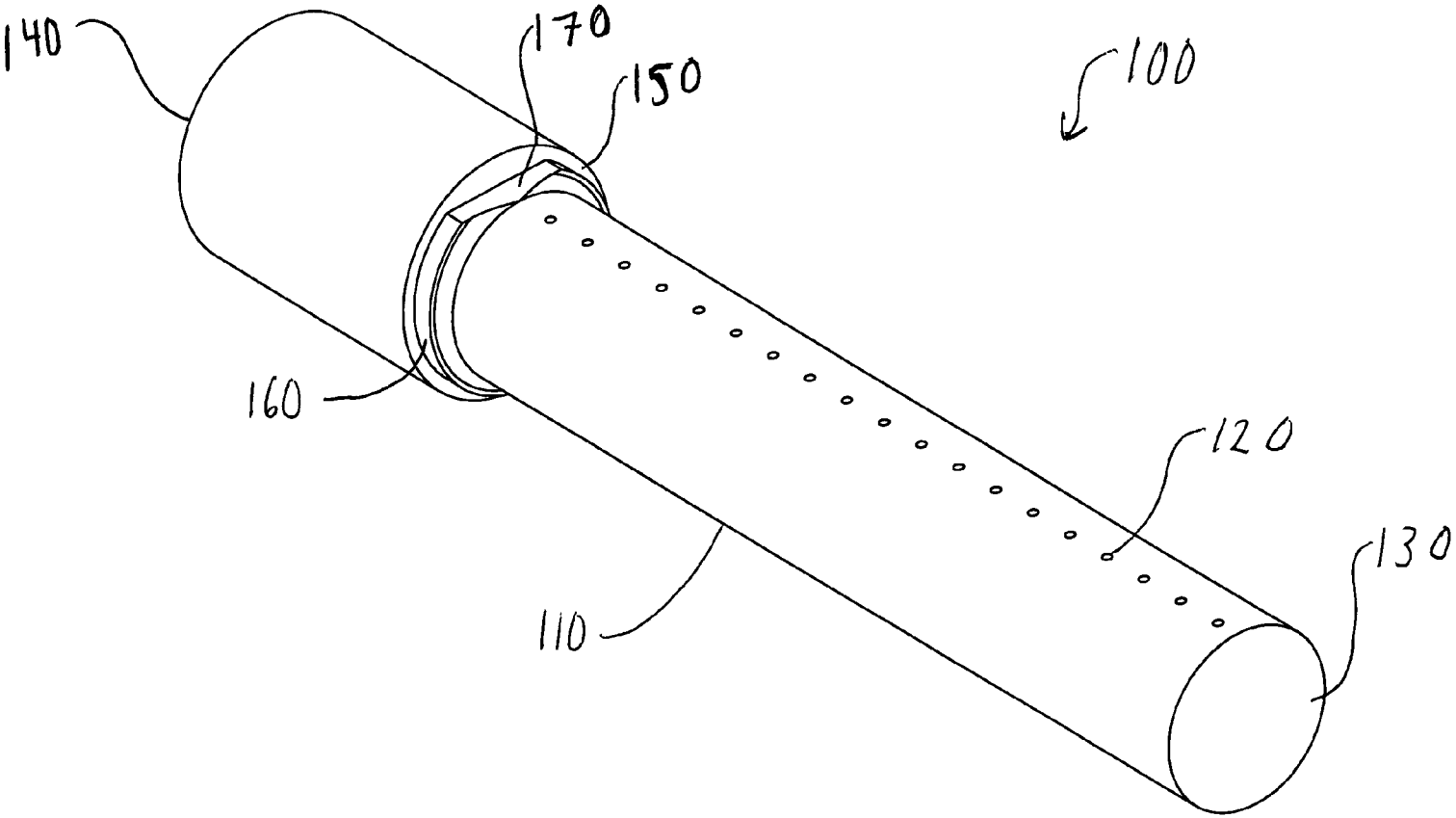
FIG. 1 is a perspective view of a distribution pipe according to the invention.

In FIG. 1, a distribution pipe 100 according to the present invention is shown. The distribution pipe 100 comprises a distribution portion 110, which includes a hollow pipe provided with a number of holes 120. The hollow pipe has a closed end 130. On the end of the pipe opposite the closed end 130 there is a fitting portion 140. The fitting portion 140 is in fluid communication with the distribution portion 110. between the fitting portion 140 and the distribution portion 110, there is a brazing surface 150 and a guiding surface 160 in form of a ring encircling the distribution portion 110. In a preferred embodiment, there is a key recess 170 provided in the guiding surface 160. The purpose of this key recess will be described later in this application, but it might be worth noting that the key recess, in the embodiment shown in FIG. 1, is aligned with the number of holes 120.

Figure 2:
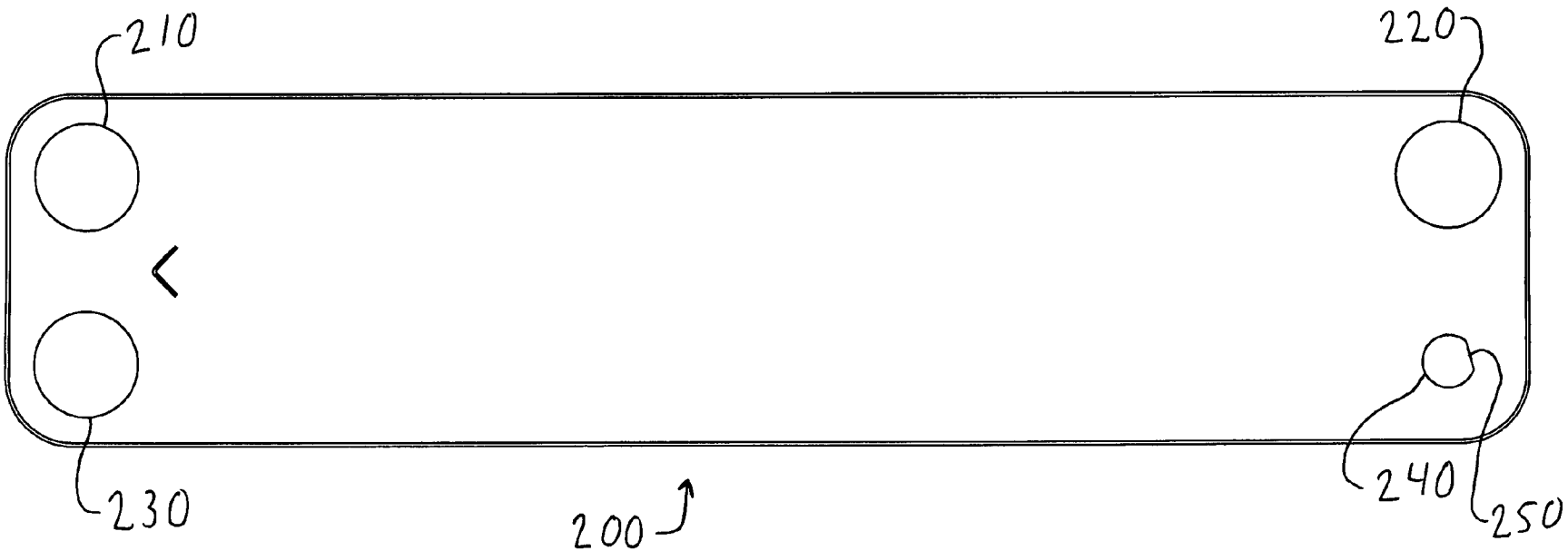
FIG. 2 is a plan view of an end plate to which the distribution pipe could be brazed.
Figure 3:
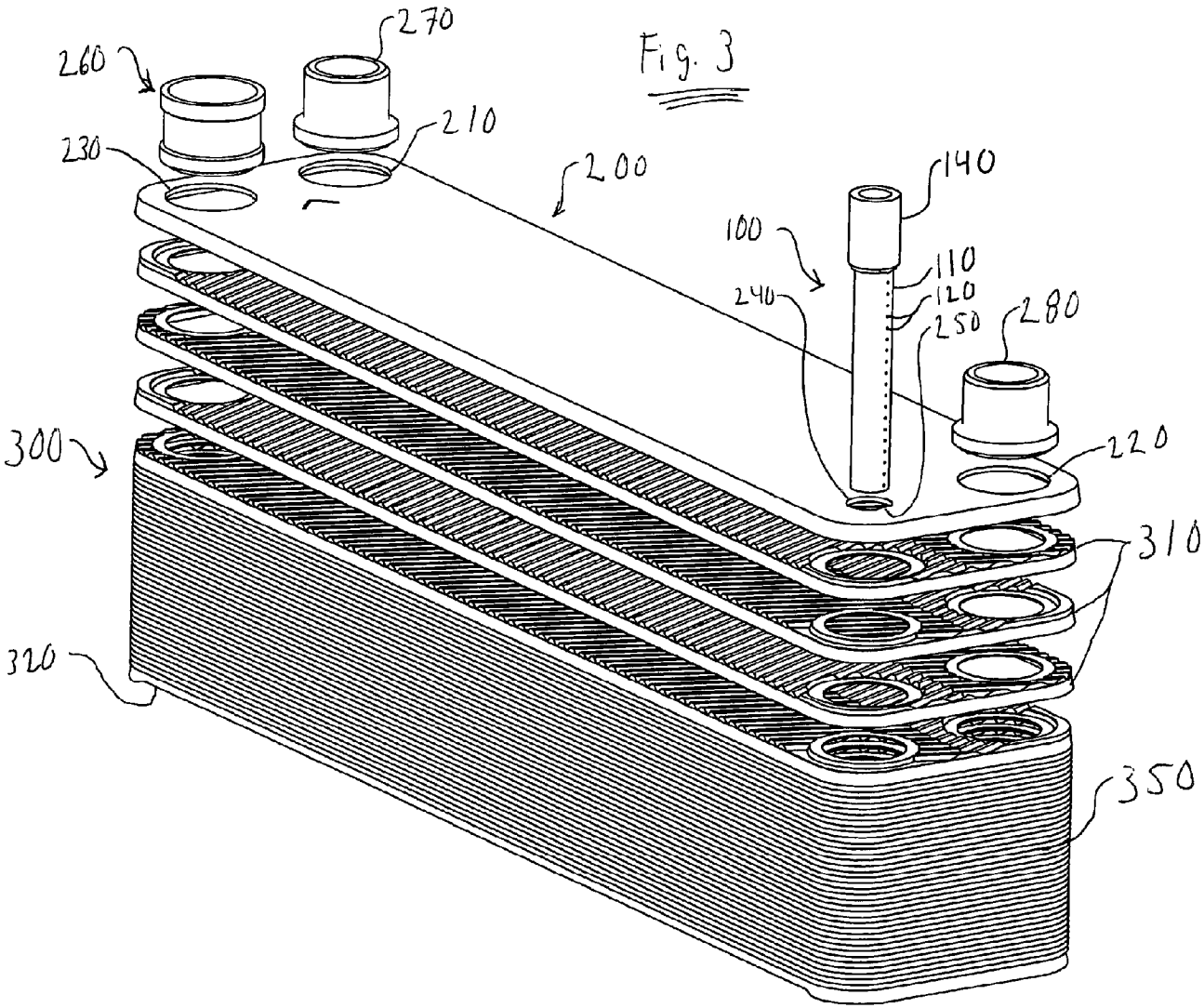
FIG. 3 is an exploded perspective view of a heat exchanger provided with the distribution pipe of FIG. 1 and the end plate of FIG. 2

FIG. 2 shows an end plate 200 of a heat exchanger 300 (see FIG. 3). The end plate 200 is provided with a brine inlet 210, a brine outlet 220, a refrigerant outlet 230 and a refrigerant inlet 240. All the inlets and outlets shown in FIG. 2 are provided as openings, and adapted to allow fastening of fittings for transferring the brine and refrigerant.

The inner diameter of the refrigerant inlet 240 is slightly larger than the outer diameter of the guiding surface 160, which means that the guiding surface will fit in the refrigerant inlet 240. As the guiding surface 160 and the inner diameter of the refrigerant inlet 240 mate, the brazing surface 150 will engage an upper surface of the end plate 200, and hence provide a possibility to braze the end plate 200 to the brazing surface 150, in a way that that will be described later.

In a preferred embodiment of the invention, the refrigerant inlet 240 is provided with an internal guide portion 250. The internal guide portion 250 should have a shape corresponding to the shape of the key recess 170 of the guiding surface 160. By providing the internal guide portion 250 and the corresponding key recess 170, it will only be possible to insert the distribution pipe 100 into the refrigerant inlet 240 in one way, namely such that the key recess (and hence the holes 120) will point in a desired direction. In one embodiment of the invention, the holes 120 are directed such that a flow of refrigerant exiting the holes 120 will hit a wall 350 of the heat exchanger 300. If other directions for the flow of refrigerant should be desired, it is possible to change the location of the internal guide portion 250 or the key recess 170. Due to manufacturing reasons, it is however preferred to alter the position of the key recess 170.

In FIG. 3, the assembly of the distribution pipe 100, the end plate 200 and the heat exchanger 300 is shown in an exploded view. Moreover, fittings 260, 270 and 280, fitted to the refrigerant outlet 210, the brine inlet 230 and the brine outlet 220, respectively, are shown. As mentioned in the prior art section, such fittings are adapted for allowing external piping (not shown) to be connected to the heat exchanger. The heat exchanger 300 comprises a number of heat exchanger plates 310 made from pressed plates comprising ridges and grooves, wherein each plate is rotated 180 degrees with respect to its neighboring plates and wherein the heat exchanger plates are stacked to form a heat exchanger pack. On the opposite side of the end plate 200, a start plate 320 is provided. In the embodiment shown in FIG. 3, the start plate 320 is not provided with any openings, but in other embodiments, the start plate might be provided with such holes. As well known by persons skilled in the art of heat exchangers, the heat exchanger plates are also provided with port areas having different heights; hence, channels are formed in the heat exchanger pack, such that e.g. a channel in fluid communication with the brine outlet 220 also will be in fluid communication with the brine inlet 210. Another feature for the heat exchanger plates 310 is that they are pressed such that a "wall" portion surrounds each plate. The wall portion of one plate will interact with the wall portions of the neighboring plates to form a heat exchanger pack that is completely sealed from the surroundings (except from via the inlets and outlets.

Figure 4:
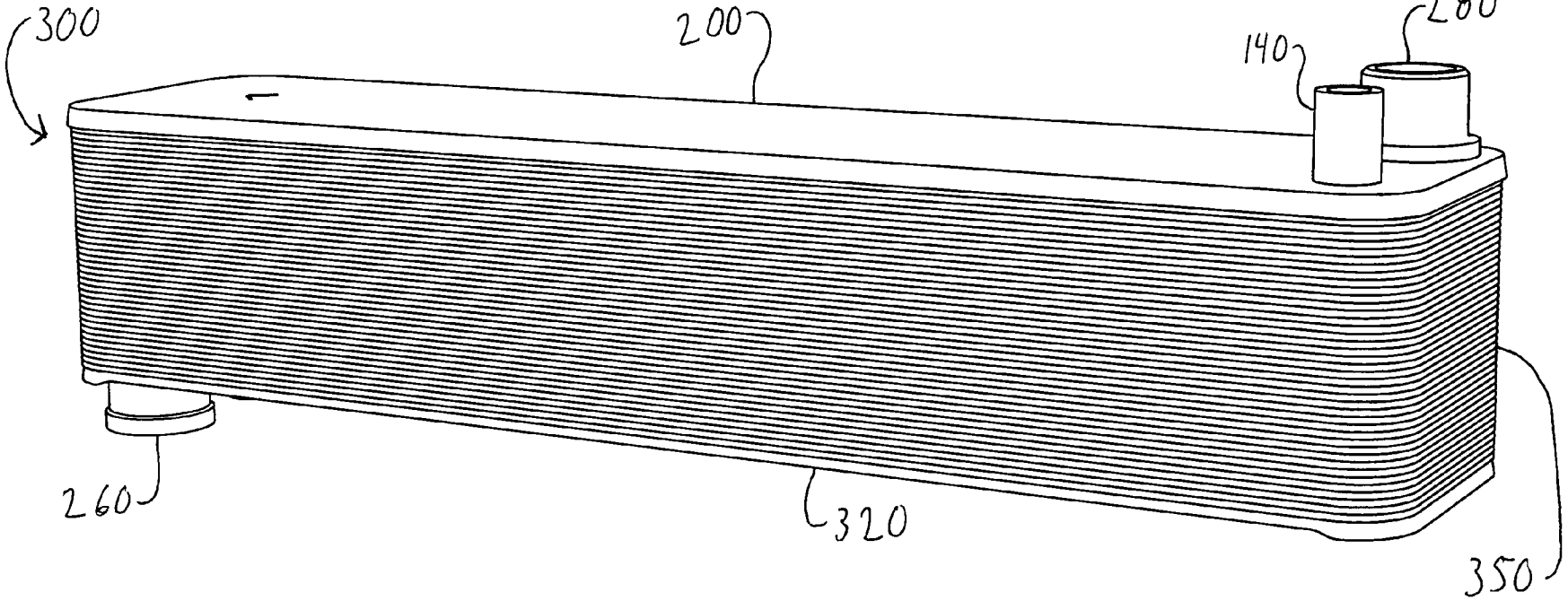
FIG. 4 is a perspective view showing an assembled heat exchanger according to one embodiment of the invention.

In FIG. 4, an assembled heat exchanger according to one embodiment comprising the distribution pipe according to the invention is shown. According to the embodiment shown in FIG. 4, the fittings 140 and 280 are mounted on the end plate 200, whereas the fittings 260, 270 (not shown) are mounted on the start plate 320. The embodiment shown in FIG. 4 is merely one example on how it is possible to arrange the fittings. In other embodiments, it is possible to e.g. mount one fitting on the end plate and all other fittings on the start plate.

Hereinafter, a typical manufacturing process usable for manufacturing a heat exchanger comprising a distribution pipe according to the invention will be described:

In a first manufacturing step, a number of identical heat exchanger plates are stacked on top of one another; a layer of brazing material is placed between neighboring plates. After all the heat exchanger plates desired for the heat exchanger have been stacked on one another, the end plate 200 is placed on top of the stack (of course with a layer of brazing material, e.g. a copper foil or a stainless steel mixed with a melting point depressant) between the end plate and the neighboring heat exchanger plate. This manufacturing step does not differ from the first manufacturing step for prior art heat exchangers.

In a second manufacturing step, the fittings 260, 270 and 280 and the distribution pipe 100 are arranged in their corresponding inlets and outlets (see above). The fittings 260, 270, 280 are preferably provided with a guide portion and a brazing surface resembling those of the distribution pipe described above. Brazing material in a sufficient amount should be placed between the brazing surfaces.

In the final manufacturing step, stack of heat exchanger plates are brazed together in a furnace. There are many types of furnaces that can be used, but they all have one thing in common, namely that they increase the temperature to a level where the brazing material melts, whereas the material in the heat exchanger plates, the end plate the fittings and the distribution pipe does not melt.

One particular problem that might occur is the possibility that the brazing material partly or fully might block one or more of the holes 120. This problem can be solved by applying a brazing material repelling material (if copper is used as a brazing material, chalk is one example of such a brazing material repelling material) into and in the vicinity of the holes.

As implied above, it might be suitable to use holes 120 of a size that gives a considerable throttling of the refrigerant flow; as an example, it might be useful with a throttling giving a pressure drop of the refrigerant of 2-5 bars.

In order to "use" the energy in the pressure drop in a desirable way, it might be desirable to design the holes in a way that maximizes the flow velocity out from the holes; this might be achieved by designing the holes with a slightly increasing diameter towards the outside of the distribution portion 110; by using such an increasing diameter, the expansion that follows by a decreasing pressure will be used as energy accelerating the refrigerant flow; as mentioned above, the holes 120 are directed such that the refrigerant flow will hit the wall 300, i.e. the wall closest to the holes 120. When the refrigerant flow hits a wall with a high velocity, droplets in the refrigerant will atomize; this is beneficial, since it is desired to avoid large droplets entering the space between the heat exchanger plates.

Above, the invention has been described by description of some embodiments. It is, however, possible to make variants on the design, without departing from the scope of the invention, such as it has been described in the appended claim set.

The invention claimed is:

1. Distribution pipe for a heat exchanger comprising at least two parallel channels for a first medium exchanging heat with a second medium, wherein the distribution pipe comprises a distribution portion provided with a number of holes provided on positions corresponding to the position of the parallel channels, wherein a fitting portion in fluid communication with the distribution portion and placed at one end of such distribution portion, wherein the fitting portion is provided with a brazing surface adapted to be brazed onto an end plate or a start plate, the distribution pipe comprises a guiding surface located between the fitting portion and the distribution portion, whose diameter is such that it snugly fits into an opening of the end plate or the start plate, wherein the guiding surface includes a cylindrical region and a flat region, and the opening of the end plate has a shape that corresponds to the flat region of the guiding surface such that the distribution pipe mounts in the opening in one direction, wherein the holes and the flat region are aligned to point in the one direction.

2. The distribution pipe of claim 1, wherein the distribution portion exhibits a closed end opposite the end provided with the fitting portion.

3. A heat exchanger provided with the distribution pipe according to claim 1.

* * * * *